United States Patent [19]

Bodine

[11] 4,358,248

[45] Nov. 9, 1982

[54] SONIC PUMP FOR PUMPING WELLS AND THE LIKE EMPLOYING DUAL TRANSMISSION LINES

[76] Inventor: Albert G. Bodine, 7877 Woodley Ave., Van Nuys, Calif. 91406

[21] Appl. No.: 102,857

[22] Filed: Dec. 11, 1979

[51] Int. Cl.[3] ..... F04F 7/00

[52] U.S. Cl. ..... 417/53; 417/241

[58] Field of Search ..... 417/53, 211, 240, 241

[56] References Cited

U.S. PATENT DOCUMENTS 46,756 3/1845 Lovegrove ..... 417/241

2,553,541 5/1951 Bodine ..... 417/241

*Primary Examiner*—Richard E. Gluck

*Attorney, Agent, or Firm*—Edward A. Sokolski

[57] ABSTRACT

A sonic pump for pumping fluid from wells and the like. Sonic energy generated by means of orbiting mass oscillators is transferred to a pair of elastic string members which function as transmission lines, one of these string members being tubular and the other being in the form of a rod mounted within the tubular member and being coextensive therewith. The two string members are tied together at appropriate points therealong and acoustically designed and excited by the sonic energy so that they vibrate in unison in a longitudinal resonant standing wave mode of vibration with lateral vibrational modes being effectively minimized. A valve system is installed in the string member which effectively displaces the fluid in the well in response to the vibratory energy such that the fluid is passed into the interior of the tubing string and then pumped up this string to the surface.

17 Claims, 12 Drawing Figures

SONIC PUMP FOR PUMPING WELLS AND THE LIKE EMPLOYING DUAL TRANSMISSION LINES

This invention relates to the pumping of fluid from wells and the like, and more particularly to a method and apparatus employing sonic energy for effecting this end result.

Sonic pumps have been available for pumping oil wells and the like for quite a number of years. Such sonic pumps are described in my U.S. Pat. Nos. 2,444,912; 2,553,541; 2,553,542; 2,702,559; 2,953,095; 3,255,699; and 3,303,782. The systems of these prior art patents employ a tubular string forming a conduit which is placed within the well casing and which has a series of check valves positioned along the string. The tubing string is sonically vibrated by means of an orbiting mass oscillator at a resonant frequency to set up standing wave vibration therealong with the vibratory energy effectively causing the check valves to pump fluid into the tubing and up out through the top thereof. It has been found particularly in deep well pumping or with viscous oil that the sonic energy attenuates rather appreciably towards the lower end of the string where it is most needed for pumping action. This, of course, necessitates the application of greater power drive at the top end of the spring in order to achieve the desired pumping action. It has also been found that parasitic lateral vibrations are often generated in the long slender strings generally employed, particularly in situations where low gravity oil is being pumped, which requires high power levels. Such lateral parasitic vibrations not only are wasteful of the sonic energy, but also cause wear and tear on the pumping string and associated equipment.

The system and technique of the present invention overcome the aforementioned shortcomings of the prior art, both in providing increased sonic energy at the lower end of the string and also in minimizing lateral parasitic vibrations. This end result is achieved in the present invention by employing a rod string within the tubing string and coextensive therewith which is vibrated in unison with the tubing string in a longitudinal resonant vibration mode having a common wave pattern. The rod and tubing strings are tightly tied together, at least at their top and bottom ends, the top ends of the strings being driven in resonant vibration by a swinging weight oscillator. As in the devices of the prior art, check valves are provided along the tubing string to implement the pumping action in response to the vibratory energy.

The amplitude of vibration along the coextensive tube and rod string members is substantially increased at the lower ends of the strings by virtue of the reinforcing action resulting from the in-phase longitudinal vibration of these two members in unison. This also results in an increased Q of the resonant vibration circuit. In one specie of the invention, the rod string is placed in compression so that it will tend to buckle and contact the inside wall of the tubing string at spaced positions therealong so as to further the "locking" of the vibration pattern of the two strings to each other.

Lateral vibration of the strings is minimized by cancelling out much of such vibration generated in the output of the swinging weight oscillator by rotating the weights in opposite directions so that their lateral vibration components are out-of phase with each other. Lateral vibration of the string members is further cancelled out in view of the out-of-phase condition by any lateral vibrational energy which may be set up in the two equal length strings, this out-of-phase condition being engendered by the markedly different impedances presented to lateral vibration by the rod and the tubing. Such out-of-phase lateral vibrations appearing anywhere along the two full length strings tend to cancel each other out. Further, lateral vibratory energy tends to be dampened by the viscous fluid located in the annulus between the coextensive tubing and rod strings.

In implementing the preferred embodiment of the invention, the tubing string is mounted for limited resilient freedom of motion vertically relative to the casing on a resilient spring mount. The rod spring is tied to the tubing string at the top and bottom ends of the tubing in the preferred embodiment to provide a common impedance in the longitudinal resonant vibration pattern along the two strings. The rod string is placed in internal location within the tubing string in this preferred embodiment and vibrates longitudinally in unison therewith, with the top and bottom ends of the tubing and rods being at antinodes of the common resonant standing wave pattern set up in the strings. In acoustics, a system with this type of wave pattern is called a "free-free" system.

It is therefore an object of this invention to increase the efficiency of operation of a sonic pump and increase the amplitude of the vibration at the bottom end of the vibratory string thereof.

It is a further object of this invention to minimize lateral vibrations in a sonic pump.

Other objects of this invention will become apparent as the description proceeds in connection with the accompanying drawings of which:

Figure 1:
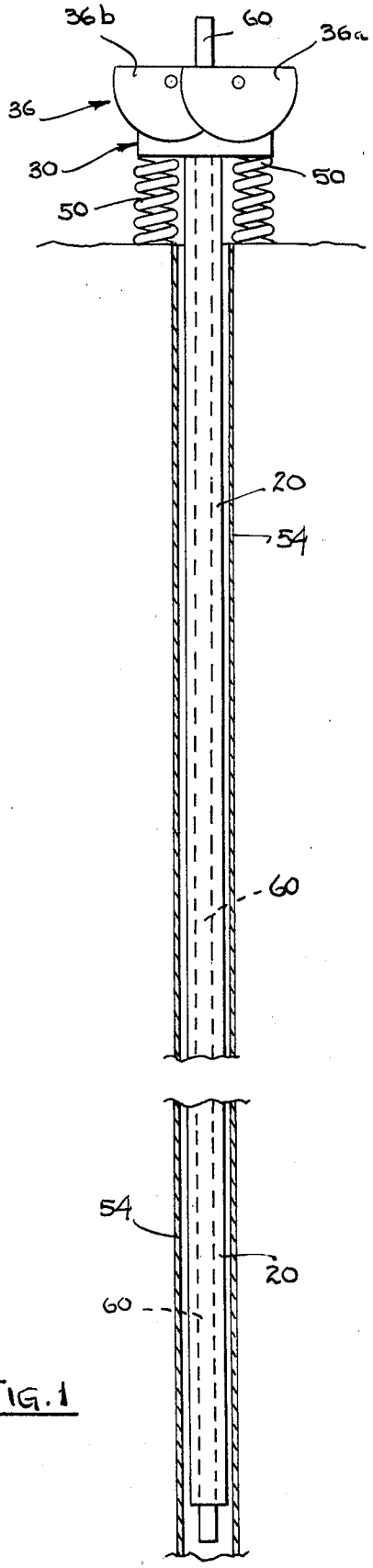
FIG. 1 is a schematic drawing illustrating the operation of the invention.

It has been found most helpful in analyzing the operation of the device of this invention to analogize the acoustically vibrating circuit involved to an equivalent electric circuit. This sort of approach to analysis is well known to those skilled in the art and is described, for example, in Chapter 2 of Sonics, by Hueter and Bolt, published in 1955 by John Wiley and Sons. In making such an analogy, force F is equated with electrical voltage E; velocity of vibration u is equated with electrical current i; mechanical compliance $C_m$ is equated with electrical capacitance $C_e$; mass M is equated with electrical inductance L; mechanical resistance (friction) $R_m$ is equated with electrical resistance R; and mechanical impedance $Z_m$ is equated with electrical impedance $Z_e$.

Thus, it can be shown that if a member is elastically vibrated by means of an acoustical sinusoidal force $F_0 \sin \omega t$ ($\omega$ being $2\pi$ times the frequency of vibration), $$Z_m = R_m + j(\omega M - 1/\omega C_m) = F_0 \sin \omega t/u \quad (1)$$

Where $\omega M$ is equal to $1/\omega C_m$, a resonant condition exists, and the effective mechanical impedance $Z_m$ is equal to the mechanical resistance, $R_m$, the reactive impedance components $\omega M$ and $1/\omega C_m$ cancelling each other out. Under such a resonant condition, velocity of vibration u is at a maximum, power factor is unity, and energy is most efficiently delivered to a load to which the resonant system may be coupled.

Just as in electrical circuitry, maximum acoustical energy can be transferred from one circuit element to another where a good impedance match exists, i.e., where the two elements have like impedance. This fact becomes particularly significant in the instant invention where efficient energy transfer from the sonic generator to the tubing and rod strings is desirable to assure optimum pumping action. By observation of Equation (1) it can be seen that the impedance $Z_m$ is high where the force $F_0$ is high, and velocity of vibration u is relative low. for proper operation of the present invention the two strings are made to vibrate longitudinally in unison by impedance matching oppositely positioned portions thereof.

Also of particular significance in the instant invention is the attainment of high acoustical Q (quality factor) in the resonant vibration system to markedly increase the efficiency of the vibration thereof and to provide a maximum amount of cyclic energy. As for the equivalent electrical circuit, the Q of an acoustically vibrating circuit is defined as the sharpness of resonance thereof and is indicative of the ratio of the energy stored in each vibration cycle to the energy used in each cycle. Q is mathematically equated to the ratio between $\omega M$ and $R_m$. Thus, the effective Q of the acoustically vibrating circuit can be maximized to make for highly efficient high amplitude vibration by minimizing the effective friction in the vibrating circuit, and/or maximizing the effective mass in such circuit. The Q of the resonant circuit in the present invention is greatly increased by employing two resonant transmission lines which are driven in unison.

In considering Equation (1), it should be kept in mind that this equation represents the total effective resistance, mass and compliance, in the acoustically vibrating circuit, and that these parameters are generally distributed throughout the system rather than being lumped in any one component or portion thereof.

It is to be noted that orbiting mass oscillators are utilized in the devices of the invention that automatically adjust their output frequency and phase to maintain resonance with changes in the characteristics of the load. Thus, in the face of changes in the effective mass and compliance presented by the load with changes in the conditions of the surrounding material as it is sonically excited, the system automatically is maintained in optimum resonant operation by virtue of the "lock-in" characteristics of applicant's unique orbiting mass oscillators. The vibrational output of such orbiting mass oscillators is generated along a controlled predetermined coherent path to provide a maximum output along the desired longitudinal axis. The orbiting mass oscillator automatcially changes not only its frequency but also its phase angle and therefore its power factor with changes in the resistive impedance load to assure optimum efficiency of operation of all times.

Figure 1A:
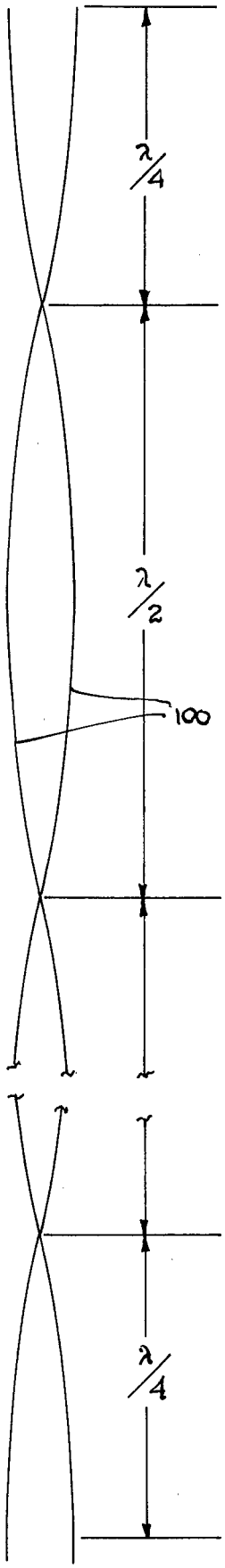
FIG. 1A is a waveform diagram illustrating a resonant standing wave pattern in the device of the invention.

Referring now to FIG. 1, the system of the invention is schematically illustrated. Platform 30 is mounted on the top end of well casing 54 by means of a spring mount 50. Rotatably supported on the spring mount is swinging weight oscillator 36 which is formed from a pair of similar, generally semi-circular swinging weight members 36*a* and 36*b*. Rod member 60 is positioned within tubing member 20, both of these members being placed within casing 54 with member 20 spaced from the casing walls. Tubing member 20 and rod member 60, which may be formed by a conventional sucker rod, are fixedly clamped to platform 30 at the same point. The swinging weights 36*a* and 36*b* are driven in opposite directions by suitable drive means, as to be explained further on in the specification, at a rotation speed such as to set up standing wave resonant vibration in the tubing member 20 and the rod member 60, as indicated by wave pattern 100. To make for the same speed of some waves in these two strings, the tubing and rod strings are made of the same material, such as a suitable elastic steel, and further, the total mass of the coupling devices used for coupling together sections of one string is made to have substantially the same fractional relationship to the total mass of that string as the total mass of the coupling devices for the other string has to the total mass of that other string. The lower ends of the tubing column and rod are tied together at a point of common impedance to the vibratory energy. In view of the above factors, when the two string members are simultaneously driven by the oscillator at a predetermined resonant vibration frequency, substantially the same longitudinal standing wave pattern, as indicated by waveform 100, (FIG. 1A) is set up in both strings such that the strings vibrate in unison with very little or no relative longitudinal movement therebetween. In view of the fact that oscillator rotors 36*a* and 36*b* are substantially identical and are rotated in opposite directions, lateral vibrations tend to be cancelled out. However, a certain small amount of lateral vibratory energy is often transferred to the string members. In view of the markedly different impedance presented by the rod and tubing members to lateral vibrations in view of their different diameters, the lateral vibrations set up in the two strings have an out-of-phase relationship with each other. This results in the effective cancellation of such lateral vibratory oscillation modes.

Figure 2:
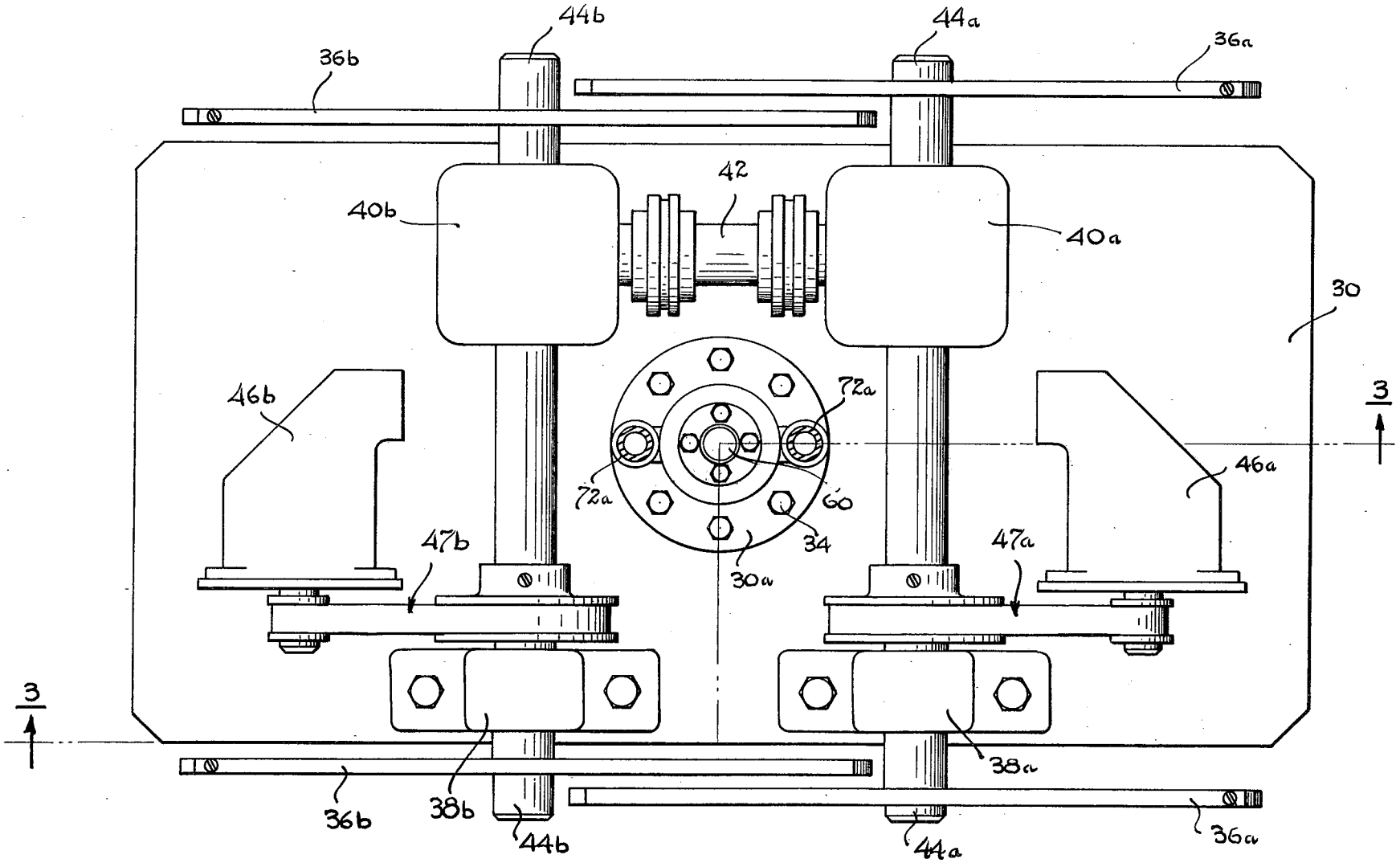
FIG. 2 is a top plan view of a preferred embodiment of the invention.
Figure 3:
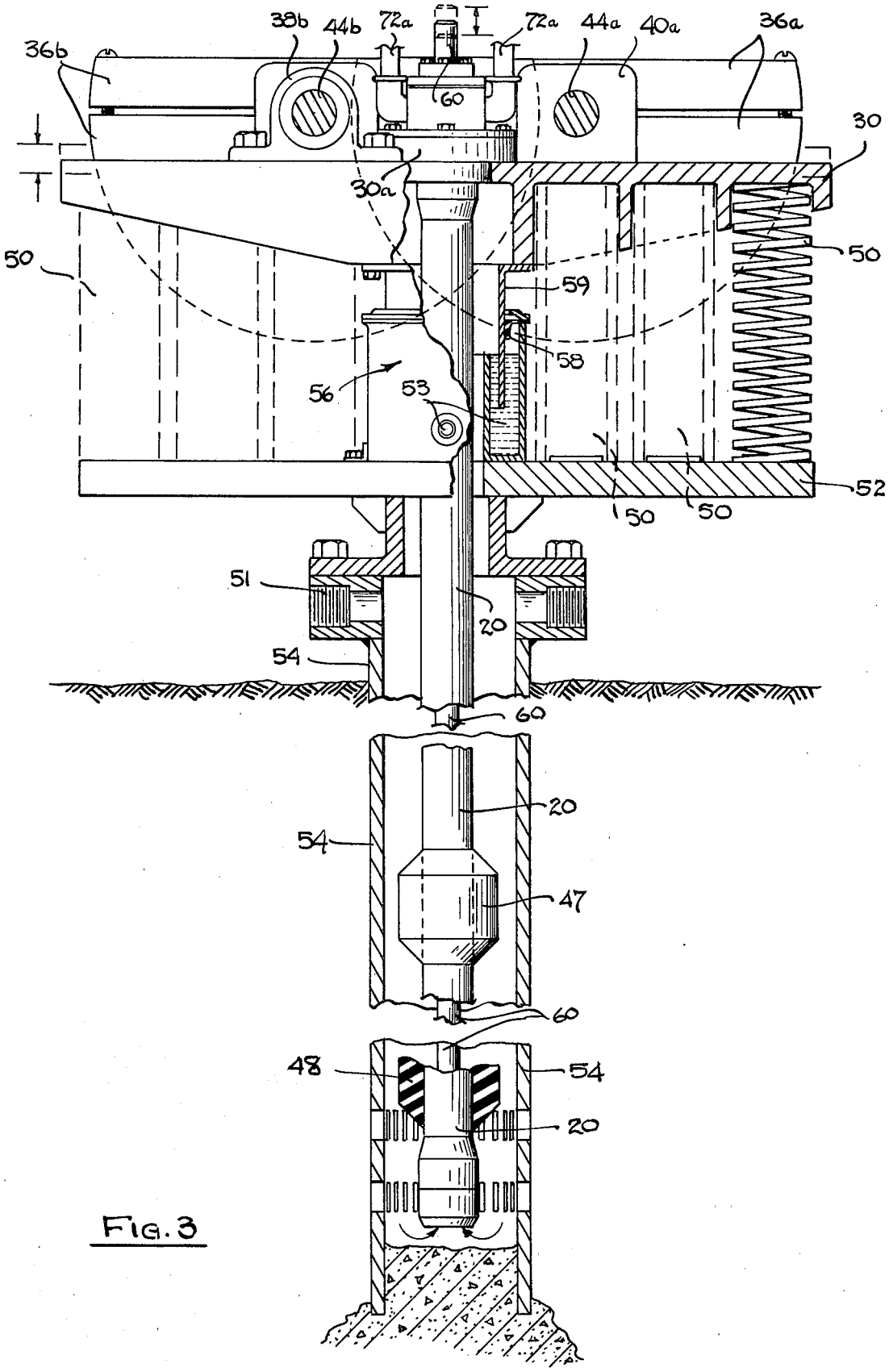
FIG. 3 is a cross-sectional view taken along the plane indicated by 3—3 in FIG. 2.

Referring now to FIGS. 2 and 3, a first embodiment of the invention is illustrated. Platform 30 is supported on base plate 52 by means of spring mounts 50. Base plate 52 is attached to the well casing 54. Swinging weight eccentric rotors 36*a* and 36*b* are attached to drive shafts 44*a* and 44*b* which in turn are rotatably driven by means of hydraulic motors 46*a* and 46*b* and standard cog belts 47*a* and 47*b* respectively. Shafts 44*a* and 44*b* are supported on pillow block bearings 38*a* and 38*b* respectively and the bearings in standard mitre gear boxes 40*a* and 40*b*, gear boxes 40*a* and 40*b* being cross-connected by phasing shaft 42. The combination of the mitre gears along with the phasing shaft keeps shafts 44*a* and 44*b* in rotational opposed phase so as to cause the swinging weights to neutralize each other insofar as lateral vibrations are concerned and to be additive in the longitudinal direction.

Guide bushing assembly 56 is mounted on base plate 52, the tubing string 20 and rod string 60 passing through this bushing. Bushing assembly 56 serves to stabilize the vertical motion of platform 30 and also provides a conduit for lubricant 53 around the vibrating tube member 20 which is particularly desirable in the case of tilted wells.

Figure 3A:
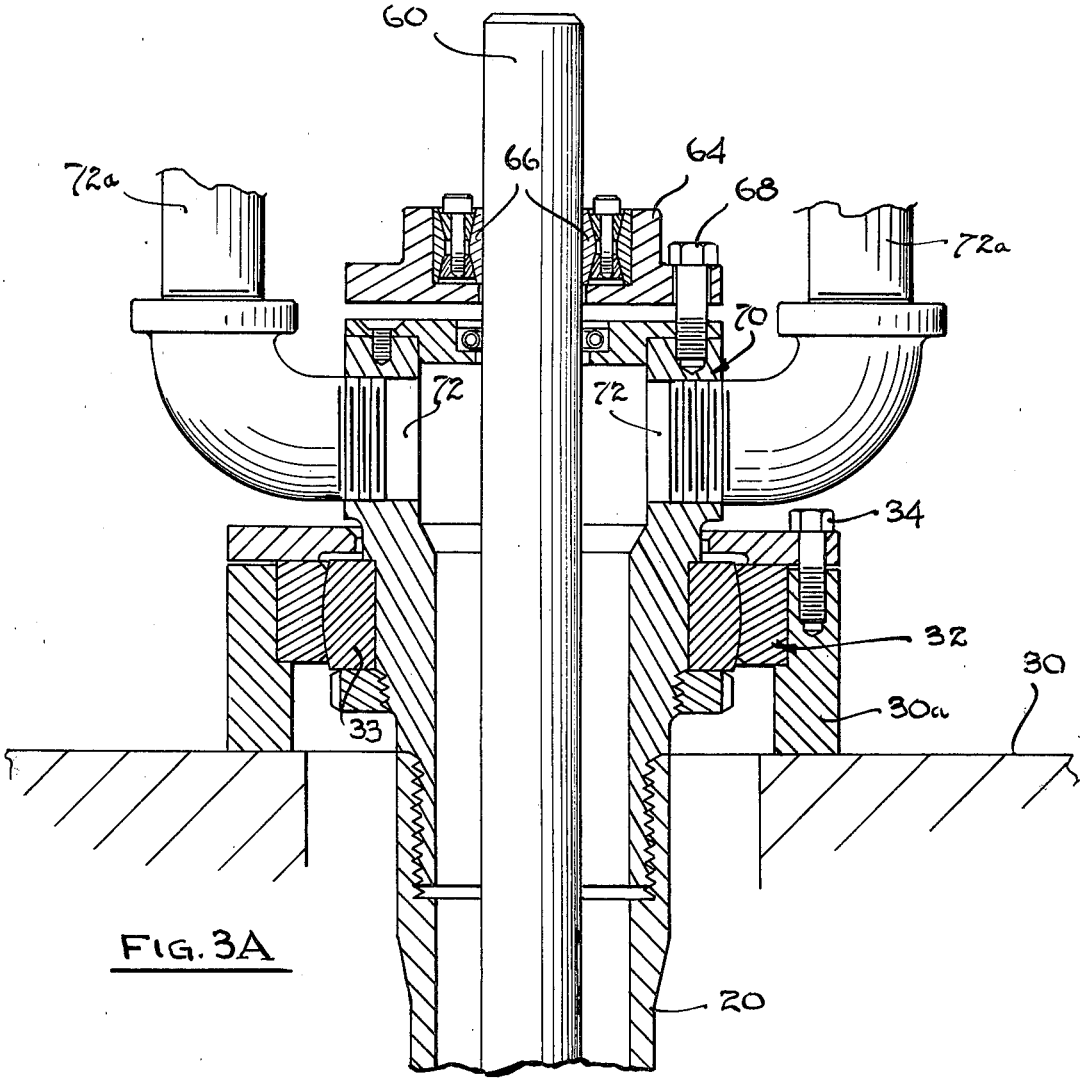
FIG. 3A is a detailed cross-sectional view illustrating the joinder between the tubing strings and the spring platform of the preferred embodiment.
Figure 4:
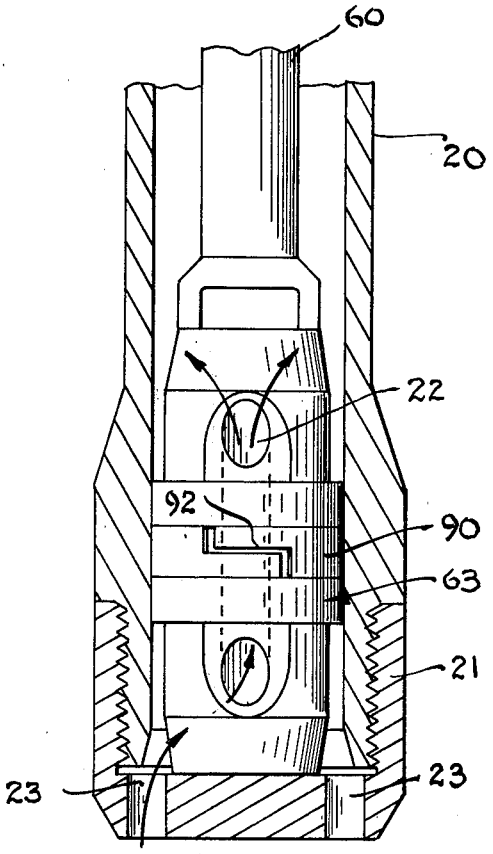
FIG. 4 is a cross-sectional view showing one embodiment of structure for joining the lower ends of the tubing and rod strings together.

As can best be seen in FIG. 3A, rod string 60 is tightly coupled to tubing string 20 by means of a clamp assembly 64 which employs wedges 66 in achieving this clamping action. Bolts 68 are employed to force the clamp assembly 64 towards the tubing manifold subassembly 70, thereby placing a compression bias on the rod string 60 so as to buckle this string by column compression buckling effect (the bottom ends of the rod and tubing strings being clamped together as can be seen in FIG. 4). The tubing string 20 is connected to platform 30 by means of ball joint assembly 32 which is bolted to an upstanding cylindrical portion 30*a* of platform 30 by means of bolts 34. A spherical sleeve bearing 33 tends to prevent lateral vibration of the tubing string 20 which might result from tipping vibration at platform 30. Fluid pumped from the well is exited from the tubing string through ports 72 formed in tubing manifold subassembly 70. Suitable flexible standard outlet lines 72*a* are threadably attached to these ports.

Figure 3B:
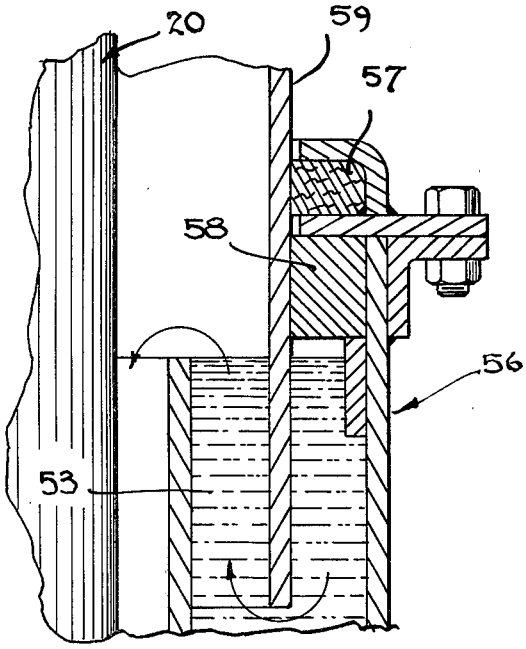
FIG. 3B is a detailed cross-sectional view illustrating the guide bushing assembly of the spring platform of the preferred embodiment.

Referring now to FIG. 3B, the details of the guide bushing assembly 56 are illustrated. This tubular assembly includes a seal gland 57 to prevent the loss of fluid or pressure therefrom. Lubricating fluid 53 is retained in the bushing and is free to flow into the space between tubing string 20 and this bushing. A bearing 58 is provided to guide stem 59, thus providing lateral stability for vertical vibration of platform 30 acting on the tubing and rod strings.

Figure 3C:
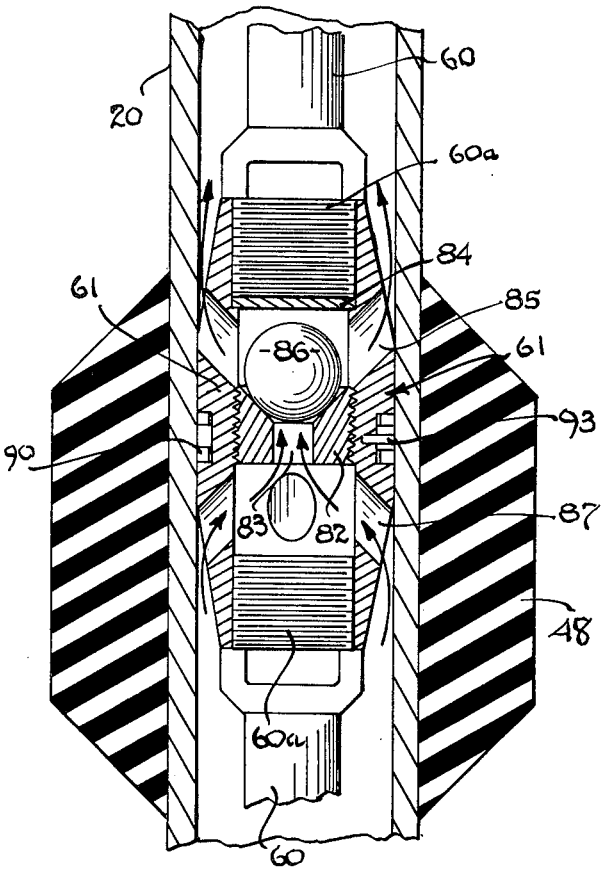
FIG. 3C is a detailed cross-sectional drawing illustrating the coupling and valve structure for the rod string of the preferred embodiment.

Referring now to FIG. 3C, the tubing string 20 is fabricated in sections which may be joined together by conventional threaded joints (not shown). Rubber bumpers 48 (see also FIG. 3) are provided at spaced intervals along the tubing to avoid transmission of vibrational energy from the tubing to the casing at these points. Rod string 60 is also made up of lengths which are joined together by couplings 61, the standard length of such section or "joint" being 20–30 feet. In the forms where the pumping valves are in the rod couplings, the rod joints or sections near the bottom of the well may be typically five feet long in order to closely space the valves so as to more evenly distribute the load and wear on the lower valves. The couplings between rod joints thus may coincide with the location of the pumping valves in one typical form, an illustrative embodiment of such a coupling and valve being illustrated in detail in FIG. 3C. The coupling 61 has a threaded bore which threadably engages the ends 60*a* of the rod sections or joints 60 to be coupled together. The threaded bore also provides threadable attachment for valve seat member 82 which has a port 83 formed therein as well as for valve keeper member 84. Valve keeper 84 is located above ports 85, which provide fluid communications to the upper portion of tubing string 20. Ball valve 86, as illustrated in FIG. 3C, is shown seated on valve seat member 82. In-flow ports 87 provide fluid communications between the lower portion of tubing string 20 and the valve.

The valve operates to pump fluid as follows: Upon the upward vibratory excursion of string members 60 and 20, ball valve 86 moves downwardly and comes to rest on valve seat 82 with upward kinetic energy being imparted to the column of oil thereabove in tubular string 20. During the downward vibratory excursion, which generally has in excess of 1 G acceleration, valve seat 82 is driven downwardly with a greater acceleration than the "G" effect of gravity can impart in the downward direction to the oil column, thus effecting a net upward pumping action through the valve entering through ports 87 and exiting through ports 85, as indicated by the arrows. This pumping action sometimes presents proportionately greater pressure loads on the valves near the bottom of the string, and in this pump it is possible to alleviate overloading by spacing the lower valves closer. Packer ring 90 around the coupling provides a seal between the coupling and the tubing wall between which there is little or no relative movement. Pins 93 which are seated in the coupler 61 may be provided to retain the packer ring prior to and during installation of the coupler as explained in connection with FIG. 8. It is to be noted that in the present invention the pump valves can be connected either directly to the tubing or to the rod string in view of the fact that these two strings vibrate in unison, the best mode of the invention employing the pump valve in the rod string, as shown in FIG. 3C.

As already noted, to assure that both transmission lines formed by the two strings have the same local wave motion therealong, the two strings are preferably coupled together at their bottom ends. This end result can be achieved as shown in FIG. 4. As shown in this figure, the bottommost valve pumping unit 63, which is constructed generally in similar fashion to the coupler pumping unit 61, is rested firmly against a cap member 21 which threadably engages the bottom of tubing string 20. Pump inlet ports 23 are provided as well as pump outlet ports 22. An elastic ring 90 is employed to provide a tight seal against the inside wall of tubing 20 with a step joint 92 being provided in this ring to permit large elastic excursions thereof and to permit the installation thereof on the coupler.

Figure 5:
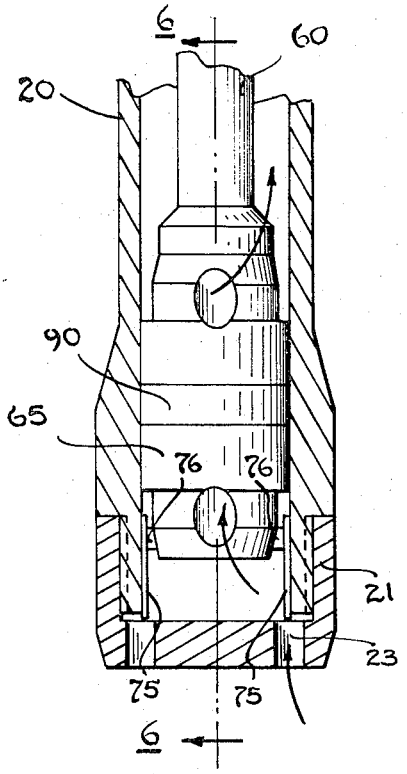
FIG. 5 is a cross-sectional view illustrating a second embodiment of the invention for joining the rod and tube members together for tensioning of the rod.
Figure 6:
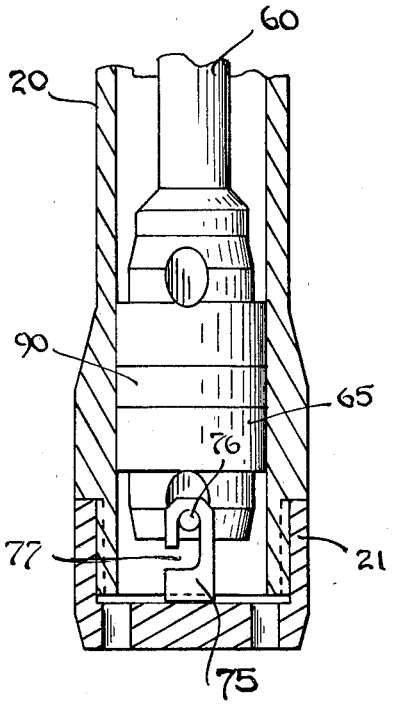
FIG. 6 is a cross-sectional view taken along the plane indicated by 6—6 in FIG. 5.

Referring now to FIGS. 5 and 6, an alternate means for attaching the rod and tubing strings together is shown, this particular embodiment being employed for tensioning the rod string with the rod string being biased in tension and the tubing string biased in compression. This embodiment of the invention is particularly useful in pumping shallow wells. In this type of system, the rod string can be fabricated from high quality steel and its coupling joints made extra strong so that the tension cycles of the longitudinal wave vibration can be confined primarily to the rod string such that the tubing string experiences mainly changes in compression stress with little or no tension so that it need not be fabricated to withstand as much stress.

As shown in FIGS. 5 and 6, thin, flat "J" shaped slotted members 75 are welded to the bottom wall of tubing string 20. The bottom of coupling members 65 of rod string 60 has pins 76 which extend therefrom and are fitted in through the bottoms of slotted members 75 and the rod string drawn upwardly with pins 76 engaging the tops of slotted members 75 (as shown in FIG. 6) in bayonet clamping fashion. This tensioning condition is maintained after pulling up on the rod string 60 by tightening the wedges 66 in clamp 64 in the top ends of the strings (see FIG. 3A). In this manner, the rod string can be effectively biased in tension with the tubular string in compression.

Figure 7:
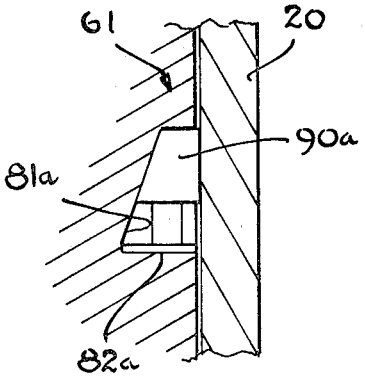
FIG. 7 is a cross-sectional view illustrating a further embodiment of the invention wherein the rod and tubing strings are joinged together at the rod string joints.

Referring now to FIG. 7, an additional device for locking the two strings together at coupling points thereof is illustrated. The structure as shown in FIG. 7 is employed with the coupler of FIG. 3C and employs the use of a different type of elastic ring 90*a* and associated retaining structure in place of the elastic ring 90 of the previous embodiment. In this embodiment, the rod coupling 61 has a tapered ring groove 81*a* formed therein with the taper having the same angle of slope as the inside surface of elastic lock ring 90*a*. Upward movement of ring 90*a* causes the ring to become tightly wedged between the inner wall of tubing string 20 and the coupler in view of the wedge effect resulting from the common contact sloping surface cooperating with the inner wall of groove 81*a*. In its installation, the ring 90*a* may be pressed to the bottom 82*a* of groove 81*a* and glued in place with a suitable adhesive. Under such attached condition, the ring 90*a* is reduced in diameter by virtue of the fact that the slope of the groove 81*a* provides extra space for the ring when the latter is in its lowermost location. It is to be noted that when it is installed, ring 90*a* has a stepped notch (as in the ring of FIG. 4) which permits circumferential reduction of the elastic ring as it is pressed down into the smaller wall diameter of groove 81*a*. As already noted, elastic ring 90*a* is glued in place against surfaces 82*a* and 81*a* in a contracted condition which provides easy freedom of introduction of the rod string 60 with its plurality of couplings 61. In this contracted condition, the elastic force of ring 90*a* is easily overcome so that the ring does not drag strongly against the strings during installation. After installation, particularly after having undergone a number of elastic cycles of vibration, the vibrational energy tends to heat the transmission line string members and their associated components such that the adhesive layers on the walls of groove 81*a* are softened and the ring is released from its contracted condition in groove 81*a*. Continued vibration of the sonic pump causes the ring 90*a* to creep upwardly in groove 81*a* wherein it becomes tightly wedged (as shown in FIG. 7), thereby tightly locking rod coupling 61 with tubing string 20. This locked condition, as already mentioned, further aids to ensure coincidence of the standing wave patterns set up in the rod and tubing strings.

When it is desired to remove the rod string from the tubing string, it is only necessary to pull up the rod string from the top end so as to cause elastic ring 90*a* to be relieved from its wedging effect against the inside of tubing 20. Reinstallation of the coupler can be readily achieved by repeating the steps just described with the elastic ring 90*a* being reglued into position on the bottom of the slot.

Figure 8:
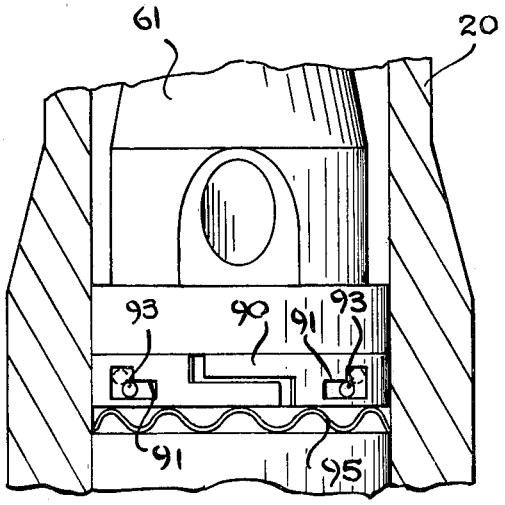
FIG. 8 is a cross-sectional view illustrating and alternative technique for joining the bottom ends of the rod and tubing strings together.

Referring now to FIG. 8, an alternate configuration for the joinder device of FIG. 4 is illustrated. In this embodiment, lock ring member 90 has J-slots 91 cut in the walls thereof at two locations. Pins 93, which are fixedly attached to the coupling 61, register in the J-slots in the innermost portions of these slots when the elastic ring is in its uppermost position and thus most greatly expanded for wedging into contact with the inner wall of tubing string 20. When the tubing and rod strings are installed in the well, the ring 90 is collapsed somewhat and pressed down on pins 93 such that the pins ride upwardly in the J-slots to the positions indicated by the phantom lines, the elastic ring thus being held in collapsed condition for easy installation without the need for adhesive glue for holding it down in position. When, however, the ring is subjected to the sonic vibration, it moves upwardly vertically with the aid of marcelle spring 95, and thus becomes wedged in locking position between the rod and tubing strings to provide tight coupling between these two members.

While the invention has been described and illustrated in detail, it is clearly to be understood that this is intended by way of illustration and example only and is not to be taken by way of limitation, the spirit and scope of this invention being limited only by the terms of the following claims.

I claim:

1. In a sonic pumping system for pumping liquid through a tubular string forming a conduit for said liquid , said system including means for generating vibrational energy at a sonic frequency coupled to one end of said string to effect resonant longitudinal vibration of said string, said string functioning as a transmission line for said energy, and valve system means mounted along said string for impelling liquid in response to said vibratory energy to effect the pumping action, the improvement comprising:

a rod string coextensive with said tubular string and means for connecting said rod string to said tubular string such that said two strings vibrate in phase unison with each other to form a vibrating circuit which vibrates in a longitudinal resonant standing wave vibration mode, the impedances of said strings to lateral vibrations being substantially different, whereby said rod string forms a second transmission line for said energy, thereby increasing the Q (quality factor) of the vibration circuit formed by said two lines and raising the level of the energy at the ends of the lines remote from the energy generating means, lateral vibrations in said two strings being out-of-phase with each other such that they tend to cancel each other out.

2. The system of claim 1 wherein said valve system means comprises a plurality of check valves mounted at spaced intervals in said rod string, said valves operating to pump the liquid through the tubular string.

3. The system of claim 1 wherein the rod string is contained within the tubular string.

4. The system of claims 1 or 3 wherein the rod string and tubular strings are connected together at least at their opposite ends.

5. The system of claim 1 and further including a well casing and means for suspending said strings down within said casing.

6. The system of claim 5 and further including means for resiliently suspending said strings in said well casing for limited longitudinal motion relative thereto.

7. The system of claim 1 wherein said means for generating vibrational energy comprises a pair of similar eccentric swinging weights, means for rotatably supporting said weights and means for rotatably driving said weights in opposite directions.

8. The system of claim 1 and further including means for attaching said rod string to said tubular string with said rod string biased in tension and the tubular string biased in compression.

9. The system of claim 1 and further including means for attaching said rod string to said tubular string with said rod string in buckling compression thereby increasing the contact bias between said two strings.

10. The system of claim 3 wherein said means for connecting said strings together includes an elastic ring compressed between said two strings.

11. The system of claim 2 wherein said rod string has a plurality of sections and coupling means for joining said sections together, said coupling means comprising a member having a bore formed therein, said check valve means being mounted in said bore, said bore including inlet means for passing liquid from said tubular string to one side of said valve and outlet means for passing liquid from the other side of said valve to the tubular string.

12. The system of claim 5 and further including circumferential resilient bumper means mounted on the tubular string at spaced intervals therealong for preventing direct contact between the tubular string and the casing.

13. The system of claim 6 wherein the means for resiliently suspending said strings comprises a base plate attached to the top of said casing, a platform, spring means for resiliently supporting said platform on said base plate, said vibrational energy generating means being mounted on said platform and imparting vibrational energy thereto, said strings being attached together and to said platform whereby said platform and the strings attached thereto vibrate in unison resonantly in a longitudinal mode relative to said casing.

14. The system of claim 13 and further including guide bushing means mounted on said base plate for providing stability for the vertical motion of said platform, said guide bushing means including a tubular housing mounted on the base plate, a lubricating liquid contained in the housing, the tubular string passing through the tubular housing, the lubricating liquid being free to flow in the space between the tubular string and the housing, a guide stem member attached to said platform and extending therefrom into the liquid in said housing and bearing means mounted on said housing and abutting against said guide stem member.

15. A method for pumping fluid from a well casing comprising the steps of tightly attaching an elongated tubular string to a coextension rod string at predetermined points therealong, mounting impeller valve means along said strings, lowering said strings down within said casing, generating vibrational energy at a predetermined sonic frequency for effecting resonant longitudinal vibration of said strings and coupling said energy to said strings to cause vibrational thereof in phase-unison with each other in a resonant longitudinal vibration mode, whereby the vibratory energy causes said valve means to impel said liquid out of said casing.

16. The method of claim 15 wherein said strings are attached thereto at the opposite ends thereof.

17. The method of claim 15 wherein the rod string is formed from sections which are coupled together by means of coupler means and wherein said impeller valve means are mounted in said coupler means.

* * * * *